United States Patent [19]

Noorily

[11] Patent Number: 5,057,029

[45] Date of Patent: Oct. 15, 1991

[54] ELECTRICAL EJECT HEADER

[75] Inventor: Peter Noorily, Bridgewater, N.J.

[73] Assignee: Thomas & Betts Corporation, Bridgewater, N.J.

[21] Appl. No.: 531,195

[22] Filed: May 31, 1990

[51] Int. Cl.[5] ..... H01R 13/62

[52] U.S. Cl. ..... 439/160; 439/157

[58] Field of Search ..... 439/152-160, 439/372; 361/391, 399, 412, 413, 415

[56] References Cited

U.S. PATENT DOCUMENTS

| | | | |
|---|---|---|---|
| 4,178,051 | 12/1979 | Kocher et al. | 439/157 |
| 4,447,101 | 5/1984 | Gugliotti | 439/153 |
| 4,469,388 | 9/1984 | Narozny | 339/45 |
| 4,698,024 | 10/1987 | Maxwell | 439/160 |

OTHER PUBLICATIONS

Front and rear cover sheets and p. 14 of T&B Catalog entitled, "Ansley® Mass Termination IDC System", 1983 (3 pages).

T&B data sheet entitled, "Ansley® Low Profile PCB Male Headers with Vertical Retainer/Ejector Latches", 1988 (4 pages).

*Primary Examiner*—David L. Pirlot

*Attorney, Agent, or Firm*—Robert M. Rodrick; Salvatore J. Abbruzzese

[57] ABSTRACT

An eject header comprises an elongate insulative housing having opposing longitudinally extending sidewalls and transversely extending endwalls and a base supporting a plurality of male terminal posts therein for electrical connection with socket contacts of a complementary connector. The sidewalls, endwalls and base define a cavity for receipt of such complimentary socket connector. A pair of ejectors are mounted on the housing for pivotal movement in a plane substantially parallel to the endwalls and wherein the ejector lever is manually moveable toward and away from one of the sidewalls. The sidewall is formed to have an opening for receipt of a foot portion therethrough into the header cavity. Further, the sidewall is formed to have a sidewall portion attached to the endwall such that the sidewall portion intersects the plane of pivotal movement of the ejector lever. The attached sidewall portion, in addition to providing structural strength through the header housing, serves as a stopping surface for movement of the eject lever. By using the sidewall portion as a stop surface, the throw distance for ejecting the complementary socket connector is enhanced.

13 Claims, 3 Drawing Sheets

ELECTRICAL EJECT HEADER

FIELD OF THE INVENTION

This invention relates to an electrical vertical eject header and pertains more particularly to headers of the type providing for ejection of inter-connected electrical sockets by ejection means movably mounted on the sidewalls of the headers.

BACKGROUND OF THE INVENTION

Electrical headers are commonly used as interconnection devices for electrically connecting printed circuit boards (PCB) to electrical connectors. Typically, the electrical header comprises a plurality of terminal posts or pins arranged in one or more rows in the header. Socket contacts of female connectors, which connectors may be used to terminate conductors of an electrical cable, are received in the electrical header to make electrical contact with the male terminal posts or pins.

To assist the user in separating the female connector from the terminal posts in the electrical header, due to the significant frictional forces existing between the female contacts and the terminal posts, headers containing ejector mechanisms are in common practice. Ejector mechanisms comprising manually operable ejector levers wherein the ejector levers are mounted adjacent the endwalls of the header are known. Such an end-mounted ejector mechanism is shown, for example, in U.S. Pat. No. 4,469,388, which is assigned to the same assignee as the subject invention. Because it has become desirable in inter-connection devices to increase the density of connections made to a PCB, for example, eject headers having ejector levers mounted on the sidewalls of the headers have been developed. Sidewall mounted ejectors permit the headers to be mounted on the PCB with the endwalls of such headers arranged in abutting relation.

One problem associated with the known sidewall mounted ejectors is a weakened housing structure due to the manner in which the ejector levers are mounted. In such headers, a full section of the sidewall is typically left open, thus permitting the ejector levers to be mounted with minimal addition of dimension to the width of the connector. The open section of the sidewall of the header disadvantageously results in a weakened wall which in use tends to reduce the life of the header and occasionally causes damage to the header. Another problem associated with the sidewall mounted ejectors relates to the distance the connected female connector can be vertically moved by the ejector in order to separate the female connector from the header. Sidewall mounted ejectors commonly rely upon a stopping action provided between the ejector and cooperative structure located on the endwall of the header which limits the vertical throw-distance the female connector may be moved upon separation. Failure to provide full separation between the sockets of the female connector and the terminal posts of the header require the user to manually withdraw the connector from the header, thus increasing the potential for damage to either the header or connector.

Accordingly, it is desirable to provide an eject header having improved strength for longer life and minimal damage and also for providing maximum throw of the female connector upon operation of the ejector levers to separate the female connector from the eject header.

SUMMARY OF THE INVENTION

The primary object of the present invention is the provision of an improved electrical eject header.

A further object of the present invention is to provide an eject header comprising a sidewall mounted ejector having improved structural strength and enhanced ejection movement of a connector received in the eject header.

In accordance with a preferred form of the invention, an eject header for releasable electrical connection to an electrical connector is provided. The header is of the type including an elongated housing having a base, two opposing longitudinally extending sidewalls and two opposing transversely extending endwalls. The opposing sidewalls and opposing endwalls define a cavity therebetween. A plurality of electrical contacts is supported by the base, the contacts each having a first end extending within the cavity for electrical connection with the electrical connector and having a second end projecting outwardly from the base and defining the terminal for engagement with an electrical component. The header includes an ejector having a manually operable lever pivotally mounted on the housing for movement in a plane substantially parallel to the endwalls of the housing. The lever has a first extent projecting generally upwardly from the base and a second extent extending transversely to the lever first extent within the housing cavity. The second extent is movable upon manual movement of the lever to engage an electrical connector within the cavity and cause upward movement thereof relative to the base to eject such electrical connector from the header. As provided in the subject invention, the eject header is improved by including in one of the sidewalls a sidewall portion that is disposed between the lever first extent and the lever second extent and intersecting the plane of movement of the ejector lever.

In a further aspect of the invention, the ejector of the present invention comprises a lever including a first extent having a surface for engaging an exterior surface of a portion of one of the sidewalls when the lever is in a first position for receipt of a mateable electrical connector. The lever further includes a second extent extending transversely to the first extent, the second extent having a surface for engaging an opposing interior surface of the sidewall portion when the lever is moved to a second position wherein the mateable electrical connector is ejected from the eject header.

BRIEF DESCRIPTION OF THE DRAWINGS

FIG. 1 (*b*) is a partial top view of the connector of FIG. 1 (*a*) sectioned as seen along the viewing lines I—I.

FIG. 2 (*b*) is a partial top view of the eject header of FIG. 2 (*a*) as seen along the viewing lines II—II.

FIG. 4 (*b*) is a partial top view of the eject header of FIG. 4 (*a*) sectioned as seen along the viewing lines IV—IV.

DETAILED DESCRIPTION OF THE PREFERRED EMBODIMENT

Figure 1A:
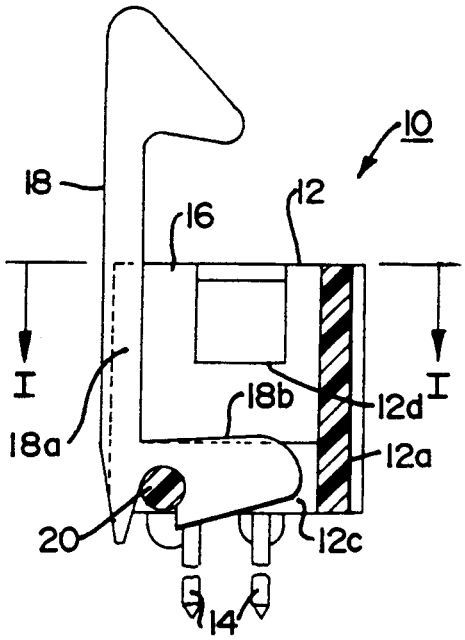
FIG. 1(a) PRIOR ART
FIG. 1 (*a*) is an end view of a prior art eject header sectioned to show details of the ejector lever.
Figure 1B:
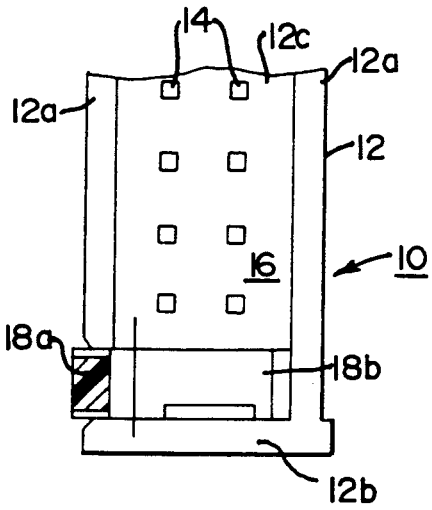

Turning initially to FIG. 1 (*a*) and FIG. 1 (*b*), there is shown a representation of a prior art eject header of the type comprising an ejector mechanism mounted on the sidewall of the header. Header 10 includes an elongate housing 12 having a pair of opposed sidewalls 12*a* extending longitudinally and a pair of opposed endwalls 12*b* (only one of which is shown) extending transversely relative to the sidewalls 12*a*. A base 12*c* supports a plurality of electrical contacts 14, for example, in two rows as shown in FIG. 1 (*b*). The sidewalls 12*a* and endwalls 12*b* define therebetween a cavity 16 for receipt of a socket connector for electrical attachment to the contacts 14.

An ejector lever 18 is pivotally mounted on a pin 20 for manual movement relative to the housing 12. The lever 18 includes a generally upstanding extent 18*a* and a transversely extending foot portion 18*b* which extends substantially parallel to endwall 12*b* and within the cavity 16. As depicted in the drawing figures, the sidewall 12*a* is separated from the endwall 12*b* by an opening extending the height of the sidewall 12*a* at the location where the lever 18 is mounted. A mechanical stop 12*d* is provided on the inner surface of endwall 12*b* and protrudes into the cavity 16 such that foot portion 18*b* engages the bottom surface of stop 12*d*. As such, the lever 18 is mechanically limited in pivotal movement by the contact between foot portion 18*b* and stop 12*d*. Accordingly, the vertical movement of foot portion 18*b*, which causes ejection of a socket connector received in cavity 16, is limited in its throw distance, i.e., the vertical distance the socket connector is moved upward from base 12*c*. Additionally, the separation between sidewall 12*a* and endwall 12*b* disadvantageously provides a weakened structural housing during use of the eject header 10.

Figure 2A:
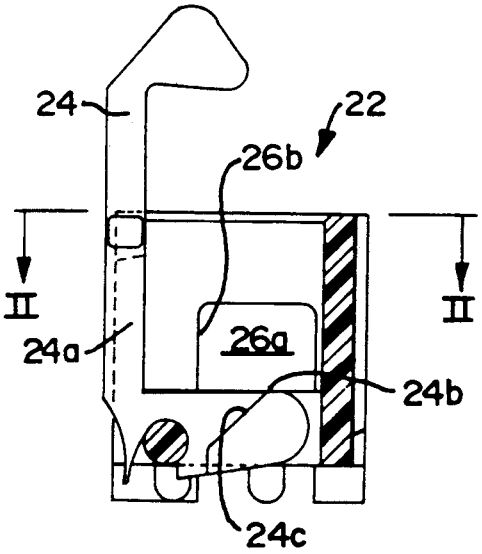
FIG. 2(a) PRIOR ART
FIG. 2 (*a*) is an end view of another prior art eject header, sectioned to show internal details of the ejector lever.
Figure 2B:
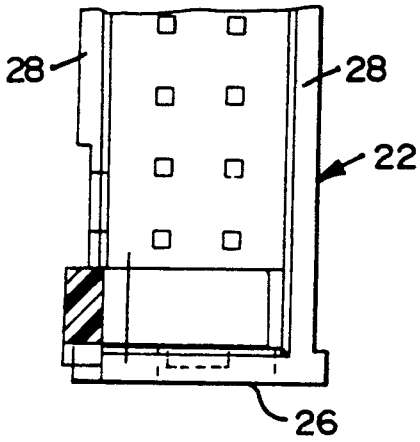

Referring now to FIGS. 2 (*a*) and 2 (*b*), another known prior art eject header is depicted. Eject header 22, is constructed similar to the header 10 shown in FIGS. 1 (*a*) and 1 (*b*), except for the provision of the mechanical stop for the ejector mechanism. Header 22 comprises a lever 24 which has a generally upstanding extent 24*a* and a transversely extending foot portion 24*b*. An endwall 26 has a cutout 26*a* formed therethrough, one edge 26*b* of which defines a stop surface for engaging a surface 24*c* on the foot portion of ejector 24. Thus the throw distance for ejecting a socket connector is limited upon such engagement. Further, one of the sidewalls 28 is fully separated from the endwall 26 to accommodate the mounting of the ejector 24, thus weakening the housing structure of eject header 22.

Figure 3:
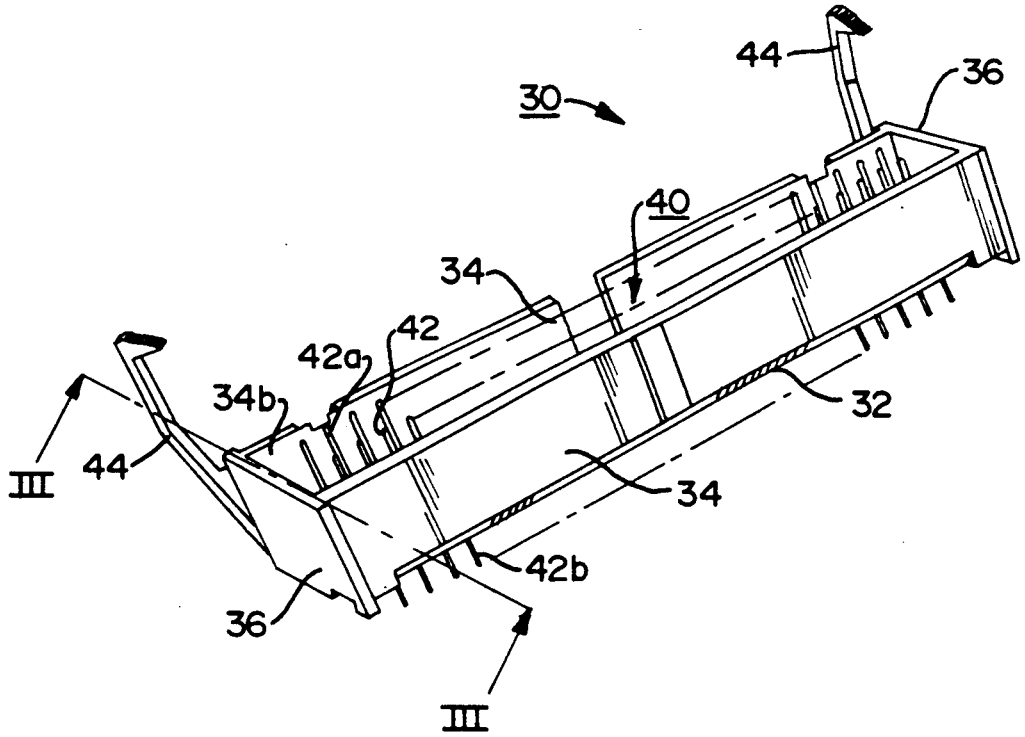
FIG. 3 is a top perspective view of the eject header of the present invention in accordance with a preferred embodiment thereof.
Figure 4A:
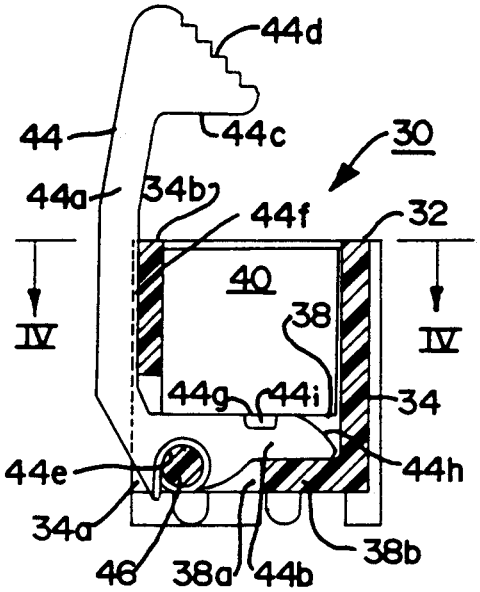
FIG. 4 (*a*) is an end view of the preferred embodiment of the eject header shown in FIG. 3, sectioned as seen along the viewing lines III—III thereof.
Figure 4B:
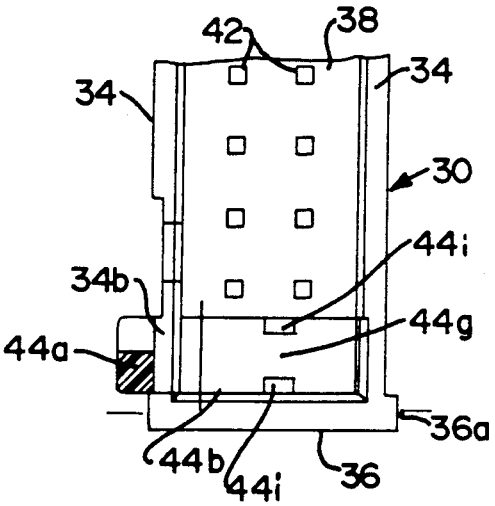

Turning now to FIG. 3, the details of the improved eject header of the subject invention may be more fully understood. Eject header 30 is of the type including a side-operated ejector mechanism. Header 30 comprises an elongated housing 32 having two opposing longitudinally extending sidewalls 34 and two opposing transversely extending endwalls 36. As shown in FIGS. 4 (*a*) and 4 (*b*), the housing 32 further includes a base 38 from which the sidewalls 34 and endwalls 36 generally vertically upstand. The sidewalls 34 and the endwalls 36 define therebetween a cavity 40 for receipt therein of a mateable female socket connector (not shown). In the preferred form, the housing inclusive of the sidewalls 34, endwalls 36 and base 38 is integrally formed, with sidewalls 34 being attached to endwalls 36.

Supported by base 38 are a plurality of terminal posts or male pins 42 arranged in two longitudinally extending rows, although other arrangements of such pins may be used. The pins, as illustrated in FIG. 3, each comprise a first end 42*a* extending within cavity 40 for electrical engagement with complementary female contacts of a mateable socket connector. Projecting downwardly from the base 38, each of the pins 42 includes a second end 42*b* which define terminals for electrical engagement with conductors of an electrical component such as a printed circuit board (PCB). In the embodiment shown, second ends 42*b* are illustrated in a straight configuration, it being understood that second ends 42*b* may also be configured in a right angle configuration.

In the preferred arrangement of the eject header 30, a pair of ejector levers 44 are mounted on the housing 32 at opposite longitudinal ends of the housing 32 adjacent endwalls 36 for pivotal movement outwardly from one of the sidewalls 34. By reference further to FIGS. 4 (*a*) and 4 (*b*), the details of the ejector levers and the cooperative housing structure for mounting the levers are shown. Each lever 44 comprises a generally upstanding vertical extent 44*a* and a second transversely extending foot portion 44*b*. At the upper distal end of the lever 44, an overhanging projection 44*c* is provided for retentive engagement with the housing of a complementary mateable connector socket. Serrations 44*d* are preferably provided on the top of overhanging portion 44*c* to facilitate manual movement of the lever 44. The ejector 44 is preferable formed of metal and is configured generally to have L-shape with the foot portion 44*b* being substantially perpendicular to the upstanding extent 44*a*.

One of the housing sidewalls 34 is formed to have an opening 34*a* adjacent the lower portion of the housing 32, near the base 38. The base 38 is formed to have an opening 38*a* communicating with sidewall opening 34*a*. Extending longitudinally relative to the housing 32 is a pivot pin 46 which extends across the opening 38*a* and is attached to the base 38 and the adjacent endwall 36. The lever foot portion 44*b* during assembly of the lever to the housing is inserted through the opening 34*a*. The lever 44 includes a curved cradle 44*e* which retentively receives the pivot pin 46 therein. The upstanding lever extent 44*a*, upon mounting the lever to the pin 46, extends outwardly of the sidewall 34, a portion of the sidewall 34*b* (FIG. 3) being attached to the endwall 36 and being disposed between the vertical extent 44*a* and the lever foot portion 44*b*. Upon pivotal movement of the lever 44, the lever 44 inclusive of the foot portion 44*b*, moves in a plane substantially parallel to the plane 36*a* of endwall 36, as shown in FIG. 4 (*b*). The sidewall portion 34*b*, being attached to endwall 36, thus intersects the plane of movement of the lever 44.

The lever 44 includes a stop surface 44*f* interiorly on the vertical extent 44*a* for engagement with an exterior surface of sidewall portion 34*b*. Thus lever 44 is prevented from pivotally moving into the housing cavity 40. Lever foot portion 44b is provided with an upper stop surface 44g which is adapted to engage an inner surface of the sidewall portion 34b. Thus, as will be described, upon movement of the lever 44, the foot portion 44b may be moved through an arc for providing maximum ejection of a complementary socket connector before stop surface 44g strikes the interior surface of sidewall portion 34b. Distal end 44h of foot portion 44b provides an engagement surface for contacting the under-surface of a complementary connector for ejection, as will be illustrated hereinafter.

In a preferred form of the ejector lever 44, there is provided in the upper stop surface 44g of foot portion 44b, a pair of recesses 44i extending within surface 44g at the opposed marginal edges of the foot portion 44b. Recesses 44i serve as means for reducing a shear effect that may occur upon the stop surface 44g engaging the wall portion 34b adjacent the opening 34a. Additionally, the base may be formed to have a lower ledge portion 38b communicating with opening 38a to serve as a further stopping surface for foot portion 44b.

Figure 5:
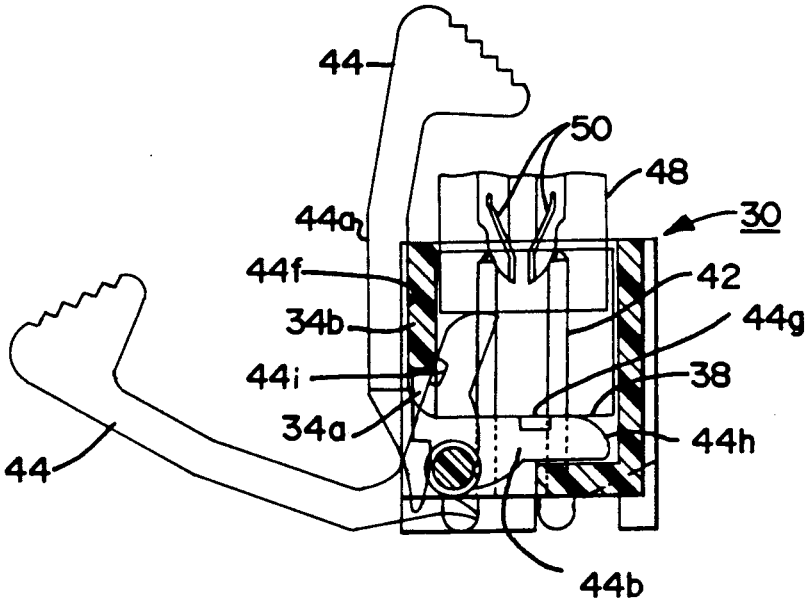
FIG. 5 is a view similar to the view of FIG. 4 (*a*) showing the preferred form of the subject eject header in two extreme stages of operation.

By reference now to FIG. 5, the operation of the improved eject header is described. In a first position, ejector lever 44 is shown with the upstanding extent 44a in a vertical position. A complementary socket connector 48 with mateable contacts 50 therein is seated in eject header 30. In this position, stop surface 44f is in engagement with wall portion 34b, or closely proximate thereto. Stop surface 44g is substantially flush with the upper surface of base 38, such that the socket connector 48 may be fully seated within the header 30. Upon manual pivotal rotation of the lever 44 to a second position, the foot portion 44 vertically moves the connector 48 upwardly to cause separation of the contacts 50 of the socket connector 48 from the pins 42 of the header 30. At the maximum trajectory of foot portion 44b, stop surface 44g engages the inner surface of the wall portion 34b. As a portion of the lever foot portion 44b extends into the opening 34a which is located below and communicating with the sidewall portion 34b, the recesses 44i minimize any shear effect that may result between the side edges of foot portion 44b and the walls defining the opening 34a. Thus, the sidewall portion 34b attached to the endwall 36 not only provides enhanced structural strength to the header housing, but also provides a stop surface for increased throw-distance for ejecting the complementary mateable connector 48.

Having described the preferred embodiment of the eject header in accordance with the present invention, it should be understood that variations may be made thereto without departing from the contemplated scope of the invention. Accordingly, the preferred embodiment described herein is intended in an illustrative rather than a limiting sense. The true scope of the invention is set forth in the claims appended hereto.

I claim:

1. An eject header for releasable electrical connection to an electrical connector, said header being of the type including an elongated housing having a base, two opposing longitudinally extending sidewalls and two opposing transversely extending endwalls, said opposing sidewalls and said opposing endwalls defining a cavity therebetween, a plurality of electrical contacts supported by said base and having first ends extending within said cavity for electrical connection with said electrical connector and having second ends projecting outwardly from said base and defining terminals for engagement with an electrical component, and an ejector having a manually operable lever pivotally mounted on said housing for movement in a plane substantially parallel to said sidewalls, said lever having a first extent projecting generally upwardly from said base and a second extent extending transversely to said lever first extent within said cavity, said second extent being movable upon manual movement of said lever to engage an electrical connector within said cavity and cause upward movement thereof relative to said base, the improvement comprising:

said lever being supported on said housing adjacent one of said endwalls, and one of said sidewalls including a sidewall portion attached to said endwall adjacent said lever, said sidewall portion being disposed between said lever first extent and said lever second extent and intersecting the plane of movement of said lever, said sidewall portion having an opening through said sidewall, said opening communicating with said sidewall portion and being of size to permit said lever second extent to extend therethrough into said housing cavity, said lever first extent including a contact surface for engagement with an exterior surface of said sidewall portion, said lever second extent including a contact surface for engagement with an interior surface of said sidewall portion.

2. An eject header according to claim 1, wherein said contact surface on said lever second extent includes shear reducing means.

3. An eject header according to claim 2, wherein said shear reducing means comprises a recess extending into said contact surface of said lever second extent along at least one edge of said lever second extent.

4. An eject header according to claim 1, wherein said base includes an opening communicating with the opening in said sidewall, said housing further including a longitudinally extending pin disposed within said base opening and between said base and said sidewall adjacent said lever, said lever being pivotally supported on said pin.

5. An eject header according to claim 4, wherein said base includes a ledge portion communicating with said base opening and disposed beneath said lever second extent.

6. An eject header according to claim 1, wherein said lever first extent and said lever second extent are substantially perpendicular to each other.

7. An eject header according to claim 6, wherein said header comprises a second such lever disposed adjacent the other opposing housing endwall, said second lever being pivotally mounted for movement in a plane substantially parallel to said endwalls, said housing including a further sidewall portion disposed in intersecting relation relative to the plane of movement of said second lever.

8. An eject header for releasable electrical connection to an electrical connector, comprising:

an elongated housing including a base, two opposing longitudinally extending sidewalls upstanding from said base, and two opposing transversely extending endwalls upstanding from said base, said opposing sidewalls and said opposing endwalls defining a cavity therebetween;

a plurality of electrical contacts supported by said base having first ends extending within said cavity for electrical connection with said electrical connector and having second ends projecting outwardly from said base and defining terminals for engagement with an electrical component;

an ejector comprising a manually operable lever pivotally mounted on said housing for movement in a plane substantially parallel to said endwalls, said lever having a first extent projecting generally upwardly from said base and disposed exteriorly of one of said sidewalls and a second extent extending transversely to said first extent within said cavity, said lever being operable to permit receipt of an electrical connector within said cavity in a first position and to eject said electrical connector by movement of said lever to a second position, said lever first extent having a surface for engaging an exterior surface of a portion of one of said sidewalls when said lever is in said first position, said lever second extent having a surface for engaging an opposing interior surface of said sidewall portion when said lever is in said second position.

9. An eject header according to claim 8, wherein said lever is supported on said housing adjacent one of said endwalls.

10. An eject header according to claim 9, wherein said sidewall portion of said one of said sidewalls is attached to said endwall adjacent said lever.

11. An eject header according to claim 10, wherein said one of said sidewalls has an opening therethrough communicating with said sidewall portion, said opening being of size to receive said lever second extent therethrough into said cavity.

12. An eject header according to claim 11, wherein said contact surface on said lever second extent includes a recess extending therewithin along an edge of said lever second extent for providing shear reducing engagement with said interior surface of said sidewall portion.

13. An eject header for releasable electrical connection to an electrical connector, said header being of the type including an elongated housing having a base, two opposing longitudinally extending sidewalls and two opposing transversely extending endwalls, said opposing sidewalls and said opposing endwalls defining a cavity therebetween, a plurality of electrical contacts supported by said base and having first ends extending within said cavity for electrical connector with said electrical connector and having second ends projecting outwardly from said base and defining terminals for engagement with an electrical component, and an ejector having a manually operable lever pivotally mounted on said housing for movement in a plane substantially parallel to said endwalls, said lever having a first extent projecting generally upwardly from said base and a second extent projecting generally upwardly from said base and a second extent extending transversely to said lever first extent within said cavity, said second extent being movable upon manual movement of said lever to engage an electrical connector within said cavity and cause upward movement thereof relative to said base, the improvement comprising:

said lever being supported on said housing adjacent one of said endwalls, and one of said sidewalls including a sidewall portion attached to said endwall adjacent said lever, said sidewall portion being disposed between said lever first extent and said lever second extent and intersecting the plane of movement of said lever, said sidewall portion having an opening through said sidewall, said opening communicating with said sidewall portion and being of size to permit said lever second extent to extend therethrough into said housing cavity, said lever first extent including a contact surface for engagement with an exterior surface of said sidewall portion.

* * * * *